US007036568B2

(12) United States Patent
Yamauchi et al.

(10) Patent No.: US 7,036,568 B2
(45) Date of Patent: May 2, 2006

(54) HEAT EXCHANGER HAVING PROJECTING FLUID PASSAGE

(75) Inventors: Yoshiyuki Yamauchi, Chita-gun (JP); Michiyasu Yamamoto, Chiryu (JP); Shoei Teshima, Handa (JP); Masaki Shimizu, Nagoya (JP); Hiroshi Ogawa, Nagoya (JP)

(73) Assignee: DENSO Corporation, Kariya (JP)

( * ) Notice: Subject to any disclaimer, the term of this patent is extended or adjusted under 35 U.S.C. 154(b) by 72 days.

(21) Appl. No.: 10/413,926

(22) Filed: Apr. 15, 2003

(65) Prior Publication Data

US 2003/0192681 A1 Oct. 16, 2003

(30) Foreign Application Priority Data

Apr. 16, 2002 (JP) ..... 2002-113174

(51) Int. Cl.
*F28D 1/03* (2006.01)
*F28F 3/12* (2006.01)
*F28F 9/02* (2006.01)

(52) U.S. Cl. ..... 165/148; 165/170; 165/173; 165/175; 165/177

(58) Field of Classification Search ..... 165/148, 165/151–153, 170, 173, 175, 177
See application file for complete search history.

(56) References Cited

U.S. PATENT DOCUMENTS

| | | | | |
|---|---|---|---|---|
| 1,378,103 | A * | 5/1921 | Gal | 165/153 |
| 1,421,546 | A * | 7/1922 | Parkin | 165/152 |
| 1,893,521 | A * | 1/1933 | Modine | 165/151 |
| 2,158,383 | A * | 5/1939 | Saunders | 165/170 |
| 3,265,121 | A * | 8/1966 | Hickman | 165/170 |
| 4,228,851 | A * | 10/1980 | LaBarge et al. | 165/170 |
| 4,805,693 | A * | 2/1989 | Flessate | 165/153 |
| 4,932,469 | A * | 6/1990 | Beatenbough | 165/170 |
| 5,441,105 | A * | 8/1995 | Brummett et al. | 165/170 |
| 6,401,804 | B1 | 6/2002 | Shimoya et al. | |

FOREIGN PATENT DOCUMENTS

JP 2001041678 A * 2/2001

* cited by examiner

*Primary Examiner*—Leonard R. Leo
(74) *Attorney, Agent, or Firm*—Harness, Dickey & Pierce, PLC

(57) ABSTRACT

A heat-exchanging plate member has a pair of heat-exchanging plates, each of which has projection ribs and fluid passage forming portions arranged alternately. The pair of plates are connected to each other in a manner that the projection ribs formed in the plates, respectively, face outwardly with each other, and the projection ribs formed in one of the plates are connected to the fluid passage forming portions formed in the other of the plates, respectively, at a temperature where the strength of material is not lowered in a connecting process.

16 Claims, 9 Drawing Sheets

HEAT EXCHANGER HAVING PROJECTING FLUID PASSAGE

CROSS REFERENCE TO RELATED APPLICATION

This application is based upon Japanese Patent Application No. 2002-113174, filed on Apr. 16, 2002.

BACKGROUND OF THE INVENTION

1. Field of the Invention

The present invention relates to an exhaust gas heat exchanger in which an internal fluid passage is formed by using plate-like members. Specifically, the present invention relates to thinning the thickness of the plate-like members which are disposed adjacent with each other.

2. Related Art

A Japanese Laid-open patent application No. 2001-41678, now which is matured to U.S. Pat. No. 6,401,804, discloses a heat exchanger, such as the one described above, which is formed by only using plural heat-exchanging plates defining an inside fluid passage without using a fin member such as a corrugated fin, while having a sufficient heat-transmitting performance, i.e., necessary heat-transmitting performance. In this heat exchanger, plural projection ribs are formed on the heat-exchanging plate members to constitute the inside fluid passage in which inside fluid flows, and the heat-exchanging plate members are disposed adjacent with each other to form a core for exchanging heat. Moreover, outside fluid (conditioned air) flows in a direction perpendicular to that of inside fluid flowing in the inside fluid passage. The projection ribs serve as a disturbance generator to disturb a straight line flow of the outside fluid.

The heat exchanger described above has a component employing a clad material formed by cladding an aluminum brazing material on an aluminum core material. Each component is laminated contiguously to adjacent components to form an assembled body. The assembled body is transferred to a heating chamber for brazing while being kept in the form of the assembled body by using a jig. Then, the components are soldered with each other to form an integrated assembly.

Since the projection ribs serve as the disturbance generator which causes improvement of the heat-transferring effect of the outside fluid, the necessary heat-transferring performance is obtained without providing the fins on the outside fluid side.

As mentioned in the above described publication, when connecting components by brazing with an aluminum material, the strength of material used for the components is generally lowered in relation to an annealing temperature while brazing. FIG. 1 shows a relationship between tensile strength/proof strength of Aluminum A1100-H material and the annealing temperature when the Aluminum material is used to manufacture the core material. As understood from FIG. 1, the tensile strength/proof strength is lowered when the temperature exceeds around 200–250° C.

Thus, the thickness of the material has been selected by taking into account the lowering of the strength due to the annealing temperature, so that the withstanding pressure thereof is secured. In other words, it is required that the heat-exchanging plate has a predetermined thickness to secure the withstanding pressure for the inside fluid passage.

SUMMARY OF THE INVENTION

An object of the present invention is to provide a heat exchanging component capable of preventing the strength of its material from being lowered while a heating process is performed.

According to a first aspect of the present invention, a heat exchanging component for performing a heat exchange between an inside fluid and an outside fluid has plural heat-exchanging plate members, each of which has a projecting portion to define an inside fluid passage. In the heat exchanging component, the projecting portion disturbs a straight flow of the outside fluid flowing outside of the heat-exchanging plate members.

The heat exchanging plate member has a fluid passage forming portion connected to the projection portion to define the inside fluid passage. The shearing stress is caused at a junction between the fluid passage forming portion and the inner surface of the projecting portion.

Preferably, each heat-exchanging plate member has a contact portion contacting an inner surface of the projecting portion which forms the inner fluid passage.

Other features and advantages of the present invention will become more apparent from the following detailed description made with reference to the accompanying drawings.

DETAILED DESCRIPTION OF THE PREFERRED EMBODIMENT

Figure 1:
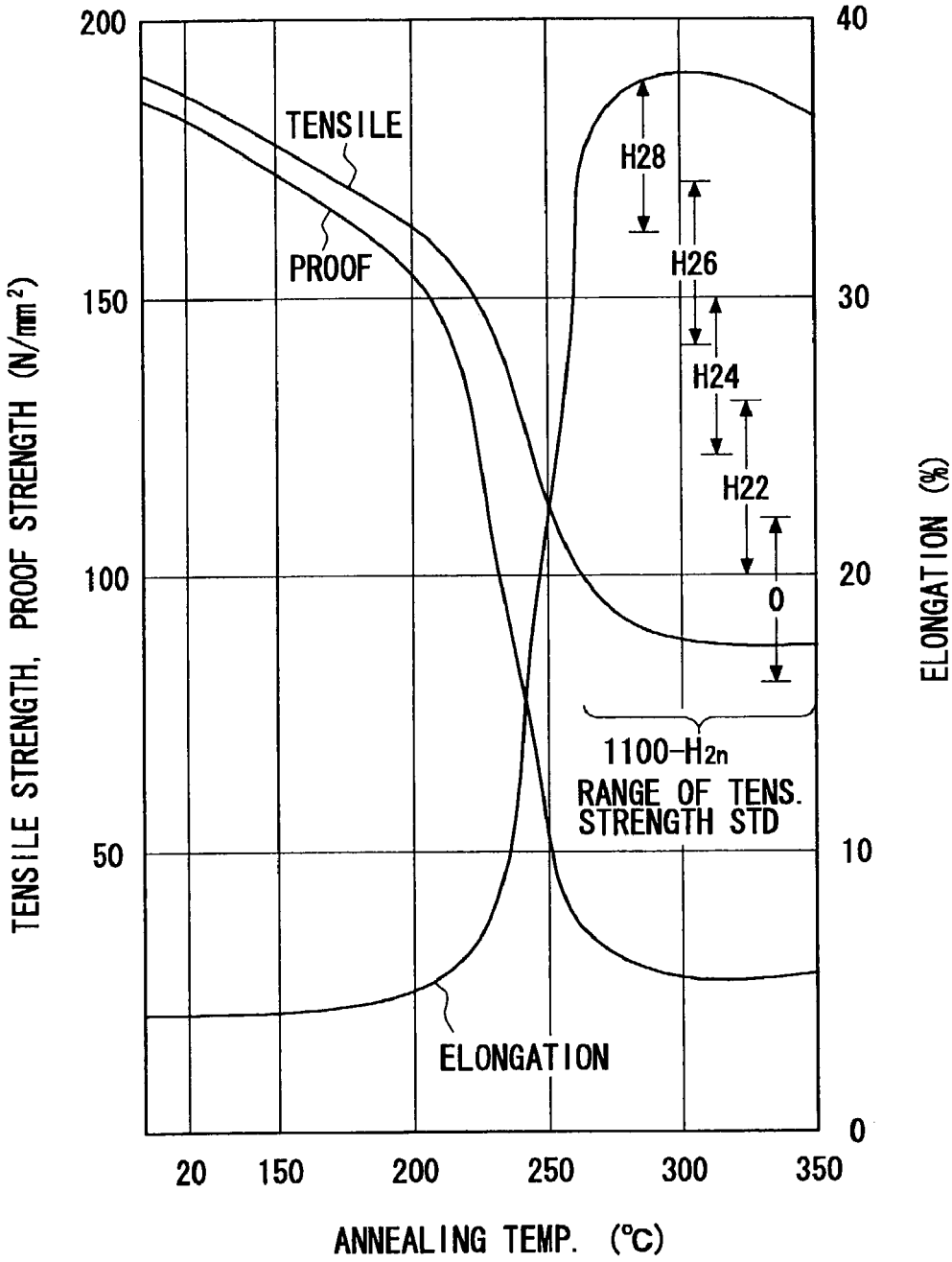
FIG. 1 is a diagram showing a relationship between tensile strength/proof strength of Aluminum A1100-H material and the annealing temperature when the Aluminum material is used to manufacture core material in the related art.

Specific embodiments of the present invention will now be described hereinafter with reference to the accompanying drawings in which the same or similar component parts are designated by the same or similar reference numerals.

A first preferred embodiment of the present invention will now be described with reference to FIGS. 2 to 6. In this embodiment, an evaporator 10, which is typically employed, for example, as a refrigerant evaporator for a vehicle air conditioner, is provided as a perpendicular-flow type heat exchanger in which a stream direction A of conditioning air is approximately perpendicular to a stream direction B (an up-down direction in FIG. 1) of refrigerant flowing in a heat-exchanging plate member 12.

The evaporator 10 has a core portion 11 for performing a heat-exchange between the conditioning air (i.e., outside fluid) and the refrigerant (i.e., inside fluid), which is formed by plural heat-exchanging plate members 12 disposed adjacent with each other. Each heat-exchanging plate member 12 is formed as a pair of plates by combining a first heat-exchanging plate 12*a* with a second heat-exchanging plate 12*b* as shown in FIGS. 3A and 3B.

Figure 2:
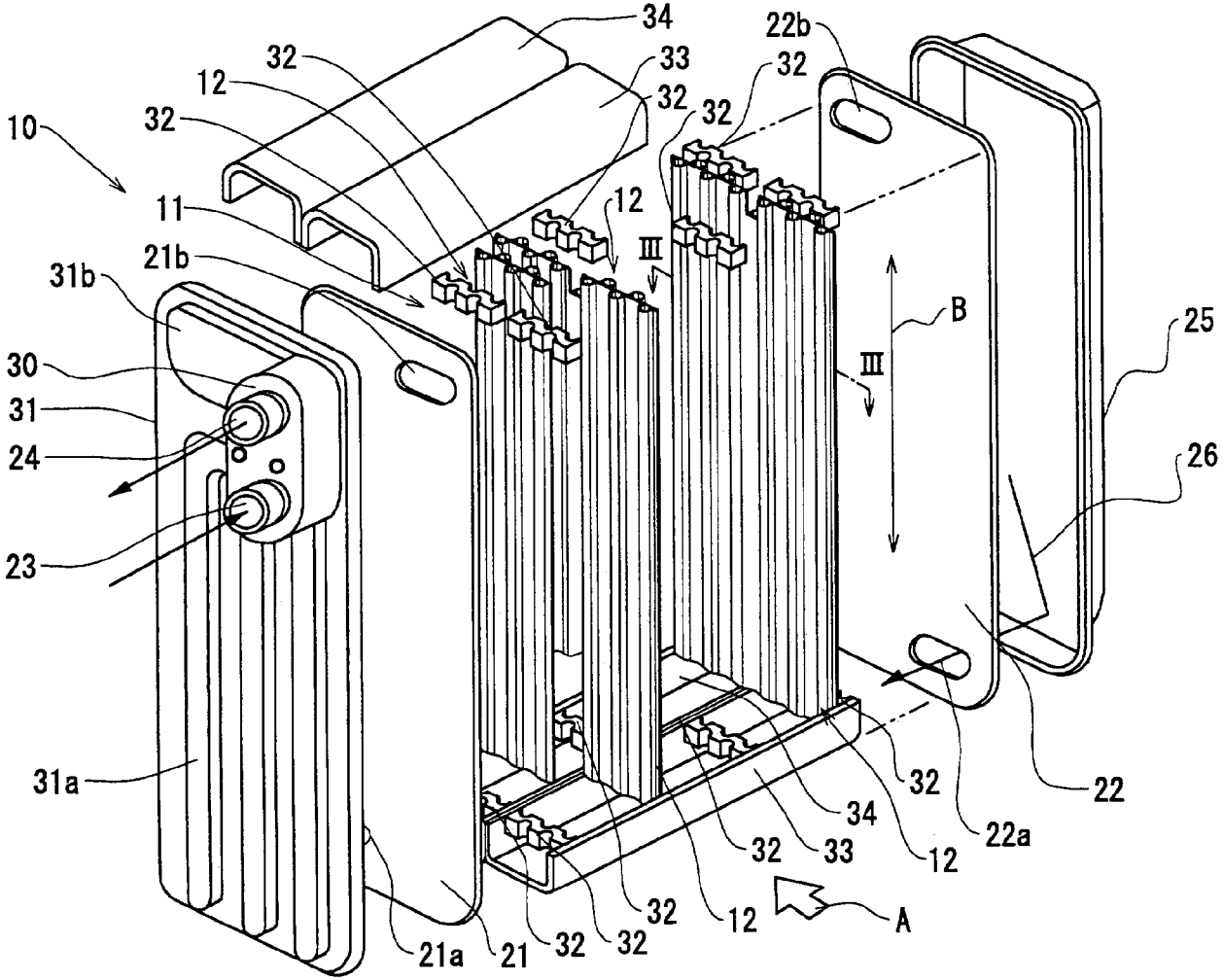
FIG. 2 is a disassembled perspective view of an evaporator according to a first embodiment of the present invention.

Each of the heat-exchanging plates 12*a* and 12*b* is a both-side clad thin plate which is formed by cladding an aluminum brazing material (e.g., A4000) on both surfaces of an aluminum core material (e.g., A3000). The thin plate is press-formed to have a plate thickness t in a range of 0.05–0.4 mm. As shown in FIG. 2, each of the heat-exchanging plates 12*a* and 12*b* is approximately formed into a rectangular shape to have the same outer peripheral dimension. For example, the rectangular shape has a longitudinal length of about 240 mm, and a lateral width of about 45 mm. Although an embossed form of each plate may be substantially the same with each other, detail shapes of plates can be different from each other for some reasons such as a shape of a refrigerant passage, a degree of ease/difficulty for assembling, a brazing structure of the evaporator and a discharge of condensed water.

Figure 3A:
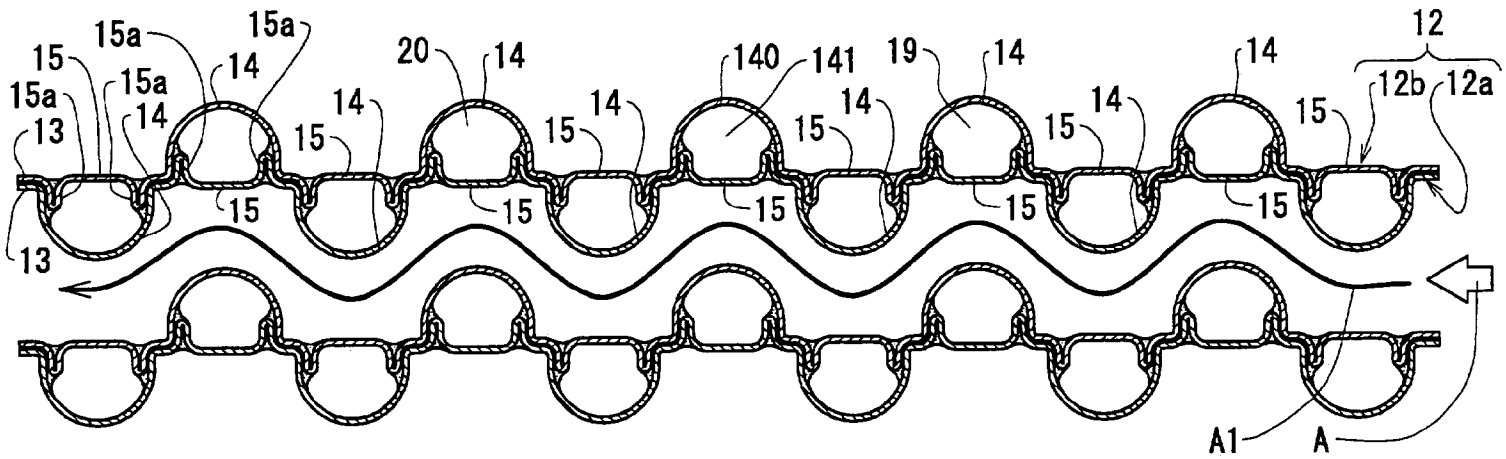
FIG. 3A is a partial cross-sectional view taken along line III—III in the first embodiment of the present invention.
Figure 3B:
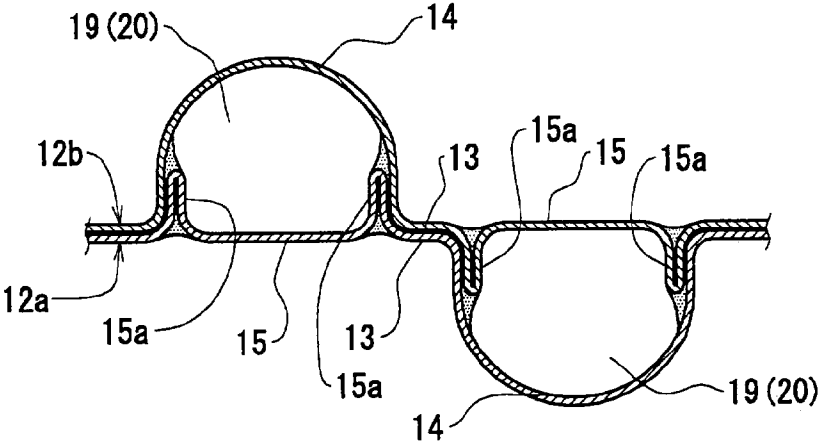
FIG. 3B is a partial cross sectional view showing the coolant passages in the first embodiment of the present invention.

As shown in FIGS. 3A and 3B, projection ribs 14 are formed on the respective plates 12*a* and 12*b* so as to project from the respective flat base plate portion 13 by, for example, an embossing process. Moreover, the projection ribs 14 formed in the first heat-exchanging plate 12*a* project in a direction opposite to a projecting direction of the projection ribs 14 formed in the second heat-exchanging plate 12*b*. The projection ribs are provided for defining therein refrigerant passages (inner fluid passage) 19 and 20 through which low-pressure refrigerant, after having passed through a pressure-reducing unit such as an expansion valve of a refrigerant cycle, flows. Each projection rib 14 extends in a direction parallel to a longitudinal direction of the heat-exchanging plate member 12, and each projection rib 14 is arranged parallel with each other. Each projection rib 14 has substantially a semicircular sectional shape as shown in FIGS. 3A and 3B.

Each first heat-exchanging plate 12*a* has six projection ribs 14, while each second heat-exchanging plate 12*b* has four projection ribs together with a projection rib 140 for detecting an inner refrigerant leakage, which is formed substantially at a center of the second plate 12*b* as shown in FIG. 3A. Although the projection rib 140 has the same shape as the projection rib 14, it is open to an outside of the heat exchanger at both of its ends for detecting the inner refrigerant leakage. The projection ribs 14 and 140 are embossed to have the same height.

Each heat-exchanging plate 12*a* and 12*b* has a fluid passage forming portion 15 provided between adjacent projection ribs 14 to have each projection rib 14, formed in the other plate 12*a* (12*b*), serve as the refrigerant passages 19 and 20. In other words, the refrigerant passage 19, 20 is formed with the projection rib 14 and the fluid passage forming portion 15. Each fluid passage forming portion 15 has two contact portions 15*a* each of which contacts an inner surface of the projection rib 14 formed in the other plate 12*a* (12*b*) as shown in FIG. 3B. Each contact portion 15*a* is formed so as to project from the base plate portion 13 along the inner surface of the projection rib 14. Namely, the refrigerant passage 19, 20 is formed by contacting and attaching the contact portions 15*a* to the inner surface of the projection rib 14. More specifically, each projection rib 14 formed in each of the heat-exchanging plates 12*a* and 12*b* is sealed with the contact portions 15*a* formed in the other plate 12*a* (12*b*) to form the passage 19, 20. The first heat-exchanging plate 12*a* has five contact portions 15*a*, while the second heat-exchanging plate 12*b* has six contact portions 15*a*. Accordingly, each heat-exchanging plate member 12 is formed by facing the first heat-exchanging plate 12*a* and the second heat-exchanging plate 12*b* in a manner that the projection ribs 14 (140) formed in the respective heat-exchanging plates 12*a* and 12*b* face outsides, respectively, to meet the respective base plate portions 13 and to meet the inner surface of the projection rib 14 and the fluid passage forming portions 15*a*, so that the projection rib 14 or 140 in the second heat-exchanging plate 12*b* is arranged between adjacent projection ribs 14 in the first heat-exchanging plate 12*a* as shown in FIGS. 3A and 3B.

In a width direction of each heat-exchanging plate 12, the refrigerant passages 19 for an upstream side are formed in the projection ribs 14 arranged at an upstream side with respect to a center portion, i.e., the leak-detecting projection rib 140, and the refrigerant passages 20 for a downstream side are formed in the projection ribs 14 arranged at a downstream side with respect to the center portion. An inner-leak detection passage 141 is formed in the leak-detecting projection rib 140. Five passages 19 for the upstream side or five passages 20 for the downstream side are formed between the heat-exchanging plates 12*a* and 12*b* in a parallel fashion.

Figure 4:
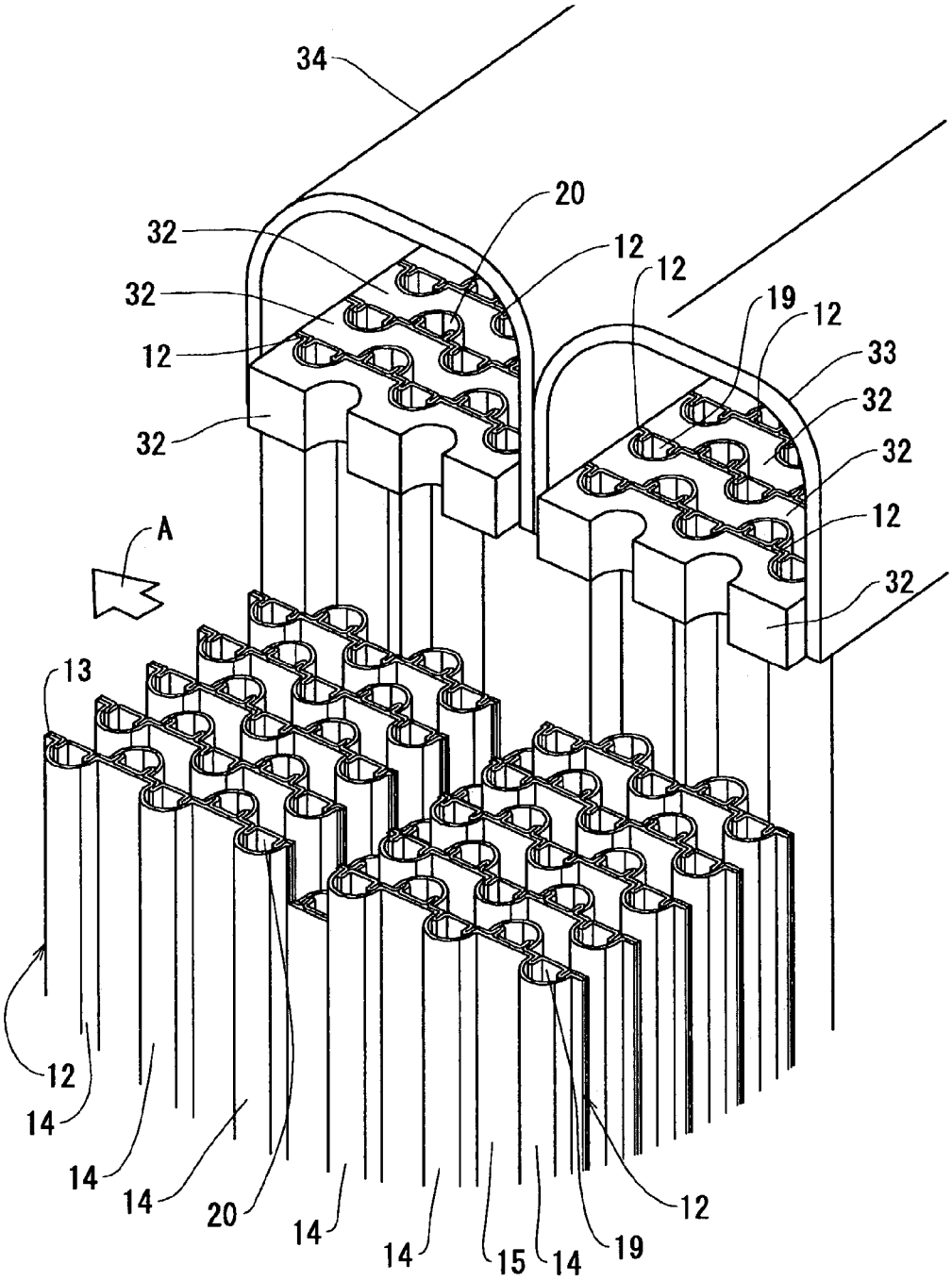
FIG. 4 is an enlarged perspective view showing a main portion of the evaporator according to the first embodiment of the present invention.
Figure 5:
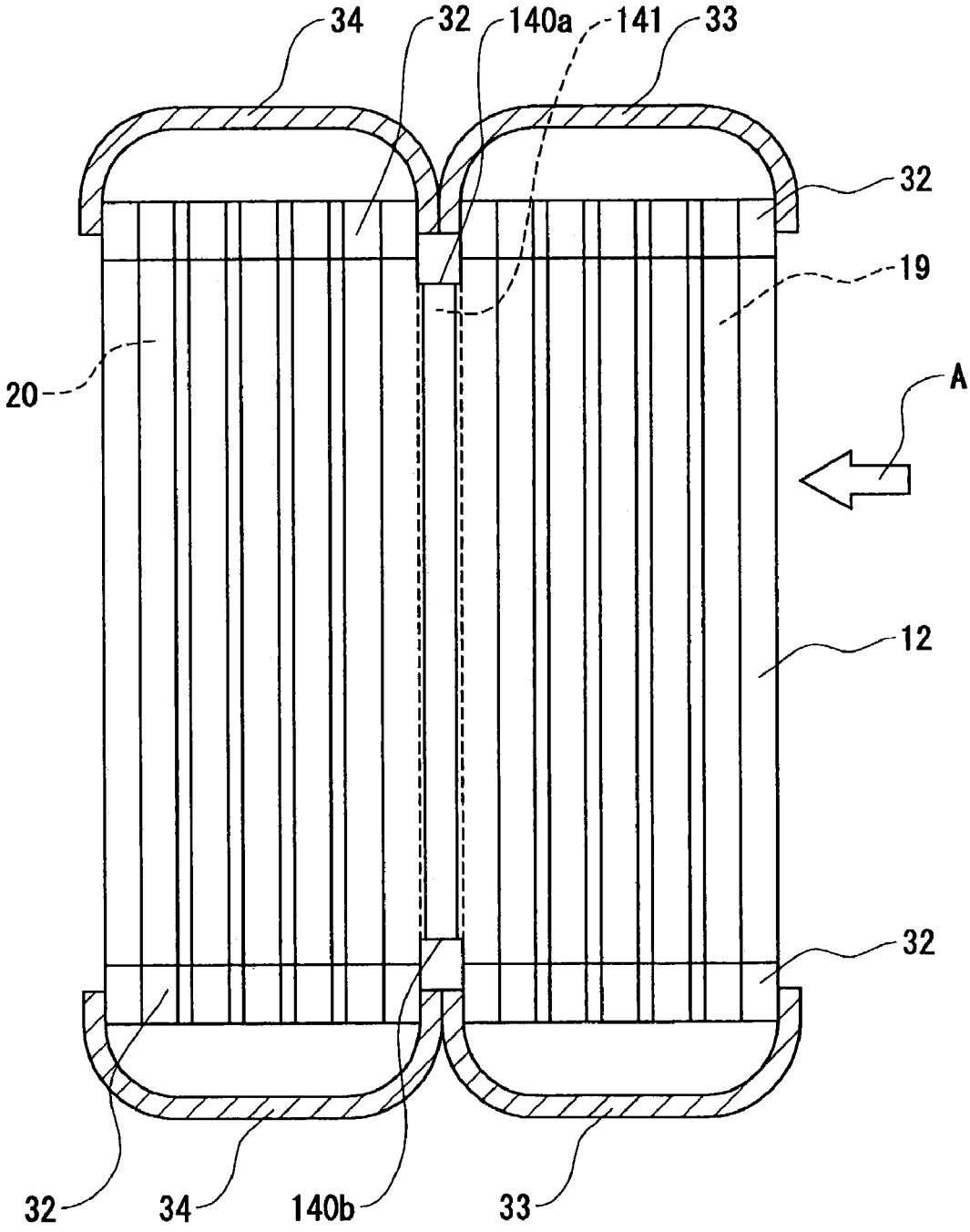
FIG. 5 is a cross-sectional view showing a heat-exchanging plate and a tank portion of the evaporator according to the first embodiment of the present invention.

Next, each heat-exchanging plate member 12 is connected to a tank member 33 at an upstream-air side and a tank member 34 at a downstream-air side at its up and down ends in a manner that each refrigerant passage 19, 20 communicates with an inner space formed in each tank member 33, 34. As shown in FIGS. 4 and 5, the interval between adjacent heat-exchanging plate members 12 is secured by spacer members 32 intervening therebetween.

The spacer member 32 is press-formed to have a shape to fit the shape of the heat-exchanging plate members 12, i.e., the arrangement of the projection ribs 14 and 140. The spacer member 32 is segmented to the upstream and downstream sides, respectively. As shown in FIGS. 2 and 4, the inner-leak detection passage 141 formed at the center portion of the heat-exchanging plate member 12 is shortened (notched) at both ends so as not to reach the tank members 33 and 34, and so as to have an upstream-side opening 140*a* and a downstream-side opening 140*b*, both of which communicate with the outside of the heat exchanger. With this feature, the spacer member 32 is segmented at the upstream and downstream sides.

Each of the spacer member 32, the tank members 33, 34 is also a both-side clad thin plate which is formed by cladding an aluminum brazing material (e.g., A4000) on both surfaces of an aluminum core material (e.g., A3000). Therefore, the core portion 11 is constituted by the plural heat-exchanging plate members 12 disposed adjacent with each other with the respective spacer members 32 intervening therebetween and by connecting them with each other to have refrigerant passages 19 and 20 which are sealed in the inner spaces formed in the downstream-side tank member 33 and upstream-side tank member 34.

Next, a portion regarding an inlet and an outlet for the refrigerant passage of the core portion 11 will be described with reference to FIG. 2. End plates 21 and 22, each of which has a size substantially equal to that of the heat-exchanging plate member 12, are provided at both ends in a disposing direction of the heat-exchanging plate members 12. Each end plate 21, 22 has a flat shape so that top portions of the projection ribs 14 are attached to a surface thereof.

The end plate 22, which is shown in the right side of the figure, has a communicating hole 22*a* provided near a lower end portion at the upstream side, which is in communication with the inner space formed in the tank member 33 positioned at a lower side of the evaporator in the upstream side of the air-stream, and a communicating hole 22*b* provided near an upper end portion at the downstream side, which is in communication with the inner space formed in the tank 34 positioned at an upper side of the evaporator in the downstream side of the air-stream. A side plate 25, which is concave facing outwardly, is provided at an outside of the end plate 22 in a manner that a refrigerant passage 26 is formed at a portion between the end plate 22 and the side plate 25 to communicate the communicating hole 22*a* and the communicating hole 22*b*.

On the other hand, to an outside of the end plate 21, which is shown in the left side of the figure, a side plate 31 is attached to form a refrigerant passage communicating with an inlet and an outlet formed in a conduit joint-block 30. More specifically, a communicating hole 21*a* is provided near a lower end portion at the downstream side of the end plate 21, which is in communication with the inner space formed in the tank member 34 positioned at the lower side of the evaporator in the downstream side of the air-stream, and a communicating hole 21*b* is provided near an upper end portion at the upstream side of the end plate 21, which is communicated with the inner space formed in the tank 33 positioned at the upper side of the evaporator in the upstream side of the air-stream.

Projection portions 31*a* are formed in the side plate 31 from a portion of the conduit joint-block 30 toward the lower portion of the side plate 31 by an embossing process so as to project outward. All the projection portions 31 are connected with each other at their ends. However, each projection portion 31*a* is independent of each other in the middle of the side plate 31 (in the figure, three projection portions 31*a* are provided), so that the strength of the side plate 31 is increased by increasing its section modulus. An upper end portion of a refrigerant passage formed by concavity portions formed inside of the projection portions 31*a* is in communication with a refrigerant inlet pipe 23 in the conduit joint-block 30. A lower end portion of the refrigerant passage in the projection portions 31*a* is in communication with the communicating hole 21*a* of the end plate 21.

A projection portion 31*b* is formed in the side plate 31 at an upper side of the conduit joint-block 30 so as to be embossed outward. A refrigerant passage formed in a concavity of the projection portion 31*b* connects a refrigerant outlet pipe 24 to the communicating hole 21*b* in the end plate 21. Gas-liquid two phase refrigerant decompressed in a decompressing unit such as an expansion valve (not shown) flows into the refrigerant inlet pipe 23, while the refrigerant outlet pipe 24 is connected to a suction side of a compressor (not shown) so that gas refrigerant evaporated in the evaporator 10 is introduced into the suction side of the compressor.

Similar to each heat-exchanging plate member 12, each of the end plates 21, 22 and the side plate 31 is also a both-side clad plate which is formed by cladding an aluminum brazing material (e.g., A4000) on both surfaces of an aluminum core material (e.g., A3000). Further, each of them has a plate thickness "t" (e.g., t=1.0 mm) thicker than that of the heat exchanging plate member 12 to increase its strength. The side plate 25 is a single-side clad plate which is formed by cladding an aluminum brazing material (e.g., A4000) on a single surface of an aluminum core material (e.g., A3000), which is connected to the end plate 22.

The refrigerant inlet pipe 23 and the refrigerant outlet pipe 24 are integrally formed on the conduit joint-block 30 by using a bare aluminum material (e.g., A6000). In this embodiment, the conduit joint-block 30 is disposed at an upper part of the side plate 31 and connected to the side plate 31.

Next, a direction of the refrigerant in the evaporator 10 will be described. The gas-liquid two phase refrigerant decompressed in the expansion valve (not shown) flows into the side plate 31 through the refrigerant inlet pipe 23. Then, the refrigerant is led into the communicating hole 21*a* in the end plate 21 through the refrigerant passage formed inside of the projection portion 31*a* of the side plate 31. After that, the refrigerant flows into an inner space of the tank member 34 located at the lower end side of the evaporator 10 in the downstream-air side. Then, the refrigerant comes up in the refrigerant passage 20 of each heat-exchanging plate member 12 at the downstream-air side to an inner space of the tank member 34 located at the upper end side of the evaporator 10 in the downstream-air side. Next, the refrigerant comes down in the refrigerant passage 26 from the communicating hole 22*b* of the end plate 22 to the communicating hole 22*a*. Then, the refrigerant flows into an inner space of the tank member 33 located at the lower end side of the evaporator 10 in the upstream-air side, and comes up in the refrigerant passage 19 in each heat-exchanging plate member 12 at the upstream-air side to an inner space of the tank member 33 located at the upper end side of the evaporator 10 in the upstream-air side. Thereafter, the refrigerant goes to the refrigerant outlet pipe 24 through the refrigerant passage formed inside the projection portion 31*b* in the side plate 31 from the communicating hole 21*b* of the end plate 21. Finally, the refrigerant flows out from the evaporator 10 through the refrigerant outlet pipe 24.

Since the refrigerant flows into the core portion 11, which the heat-exchanging plate members 12 are disposed adjacent with each other therein, from the refrigerant inlet pipe 23, the refrigerant passages 20 in the downstream-air side constitute an inlet-side refrigerant passage in the refrigerant passage of the evaporator 10. On the other hand, since the refrigerant, after having passed through the refrigerant passages 20, comes into, and flows out from the outlet pipe 24, the refrigerant passages 19 constitute an outlet-side refrigerant passage.

Next, connection of the main components in the evaporator 10 will be described. Generally, each component described above is laminated with each other so as to contact each other. The laminated components (laminated assembly) are supported to keep its configuration in a contacting state by a predetermined jig, and conveyed into a heating chamber for brazing. The laminated assembly is heated up to a temperature equal to a melting point of a brazing material to be integrally brazed to form the evaporator 10.

However, this brazing method is not good for brazing components in which an aluminum material is used as described above (shown in FIG. 1) since the strength of the aluminum material in the components is lowered in relation to the high, annealing temperature in the brazing process. Therefore, the thinning of the thickness of the components is regulated by the issue described above when the components are made from the aluminum.

In this embodiment, the fluid passage forming portion 15 is employed to form the refrigerant passage 19, 20 with the projection rib 14 by providing the contact portions 15*a* forming junction (bonding) portions with the inner surface of the projection rib 14. Moreover, a cladding material, which has a melting point of a temperature equal to or lower than 250° C., is used as a brazing material for connecting each component. Then, connecting the components (assembly) of the evaporator 10 in the contacting state is conducted in a low-temperature integral brazing process in which the assembly is heated to around 250° C. to obtain the evaporator 10.

When conducting the low-temperature integral brazing process under about 250° C., the strength of the material, which is used in the components such as the first and second heat-exchanging plates 12*a* and 12*b* or the like, is not lowered in a case where an aluminum alloy H-material or heat-treating material is used as the material. Accordingly, each component of the evaporator 10 can be thinned. Here, the aluminum alloy H-material or heat-treating material is defined in "JIS (Japanese Industrial standards) H 0001". The "H-material" is a hardened material with its stretch rate being lowered by work hardening to have superior strength.

Figure 6:
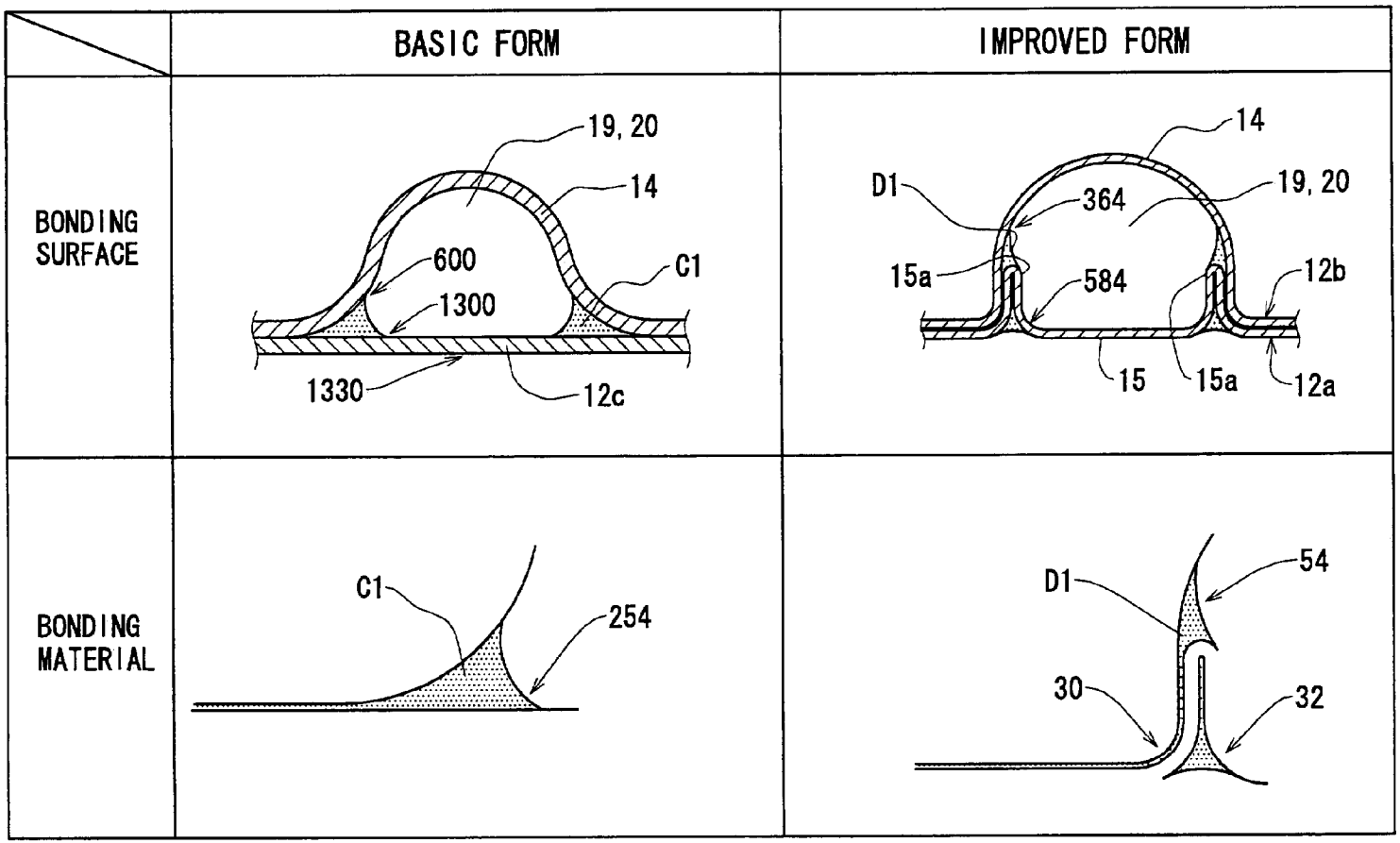
FIG. 6 is a schematic partial cross-sectional view showing the maximum principal stress in a basic structure and an improved structure of the first embodiment of the present invention.

In this embodiment, the heat-exchanging plate member 12 is designed to have stress applied to the junction portions, which is not set to the release stress but the shearing stress in the section of the refrigerant passage 19, 20. In FIG. 6, maximum principal stress is shown in each of a basic form and an improved form, i.e., the form of this embodiment, more specifically, in each of the connecting materials C1 and D1, and the bonding surfaces of the respective connecting materials C1 and D1. The basic form has a refrigerant passage 19, 20 in which a flat surface is contacted, and connected to a projection portion 14*a* which projects outward. In the figure, numerals, except the numerals denoting element members such as 19, 20, 15, 15*a* or the like, show the magnitude of the maximum principal stresses. The maximum principal stress is much larger in the basic form than in the embodiment of the present invention in every aspect.

This is generally because the releasing stress is applied to the bonding surface of the connecting material C1 and the tensile stress is applied to the connecting material C1. On the other hand, the maximum principal stress is lowered in this embodiment by causing the shearing stress at the connecting material D1 and its bonding surface, thereby increasing the strength at the connecting portion. Consequently, this increase in the strength at the connecting portion results in the fact that the thickness of the first and second heat-exchanging plates 12*a* and 12*b* can be thinned.

Next, operation of the evaporator 10 in this embodiment will be described. The evaporator 10 is installed in an air-conditioning unit case (not shown) in such a manner that an up-down direction of the evaporator 10 corresponds to the up-down direction in FIG. 2. Air is blown by operation of a blower unit (not shown) in a direction shown by an arrow "A" in FIG. 2.

When the compressor of the refrigerant cycle operates, gas-liquid phase refrigerant at a lower pressure side, which is decompressed in the expansion valve (not shown), flows into the refrigerant passage 20 at the downstream-air side though the refrigerant inlet pipe 23, as described above. Then, the refrigerant flows along the passage structure extending to the refrigerant passage 19 at the upstream-air side. On the other hand, as shown by an arrow "A1" in FIG. 3A, an air passage is formed in a wave like continuously across the entire plate width direction (air-stream direction A) in a space formed between the base plate portion 13 and the projection rib 14, 140 of the heat-exchanging member 12 in the core portion 11, which projects outward to have a convex form.

As a result, the conditioning air blown in the arrow A direction meanderingly passes through the space between the heat-exchanging plates 12*a* and 12*b* in the adjacent heat-exchanging members 12. Therefore, refrigerant passing through the refrigerant passage 19, 20 absorbs an evaporation-latent heat from air passing through the space between adjacent heat-exchanging members 12 to be evaporated, the air is cooled.

In this operation, by providing the inlet-side refrigerant passages 20 at the downstream-air side and providing the outlet-side refrigerant passages 19 at the upstream-air side with respect to the air-flowing direction A, the inlet and the outlet of the refrigerant is disposed in a countercurrent arrangement with respect to the air-stream. Moreover, the air-flowing direction A is approximately perpendicular to the longitudinal direction (i.e., the refrigerant-flowing direction B in the refrigerant passage 19, 20) of the projection ribs 14, 140 in the heat-exchanging plate members 12. Further, each of the ribs 14, 140 has an outer convex protrusion surface (heat-exchanging surface) protruding in a direction perpendicular to the air-flowing direction A. Thus, air is restricted from linearly flowing due to the outer convex surface of the projection ribs 14, 140.

Thus, the flow of the air passing through the spaces between the heat-exchanging plate members 12 is meandering so as to be disarranged, thereby becoming a turbulent flow. Accordingly, heat-exchanging effect is greatly improved. It is true that heat-exchanging area between the air passing through the space and the heat-exchanging plate members 12 is greatly reduced without fins being provided to the heat-exchanging members 12. However, sufficient cooling performance can be obtained in this embodiment because the effect caused by the reduction of the heat-exchanging area can be compensated with the improvement of the heat-exchanging rate in the air side by causing the turbulent flow of the air.

According to the first embodiment, it is revealed that in the connection (bonding portion) of the basic form in the section as shown in FIG. 6, the stress applied to the bonding surface becomes great in the release stress. On the other hand, in this embodiment, the contact portions 15*a* fitting to the inner surface of the projection rib 14 are employed, and then, the stress applied at the bonding portion is set as the release stress. Therefore, bonding strength at the bonding portion is improved so that the thickness of the first, second heat-exchanging plate 12*a*, 12*b* can be thinned to a degree that the plates 12*a* and 12*b* can withstand the pressure caused by the refrigerant passing through the refrigerant passage 19, 20.

By protruding the contact portions 15*a* along the inner surface of the projection rib 14, the stress applied at the bonding portion becomes the release stress. Thus, the low-temperature integral brazing or connecting (bonding) can be conducted according to the strength at the bonding portion. Therefore, connecting at a low temperature can be performed by improving the strength at the bonding portion thereby being capable of thinning the thickness of a member used in a evaporator.

Using heat-exchanging plates 12*a* and 12*b* which have projection ribs 14 and the fluid passage forming portions 15, respectively, and have substantially the same shape makes it possible to form a heat exchanger in a relatively small volume.

Although the strength of a material can be generally lowered in the brazing process by a high temperature in the process, the integral brazing process or connecting process is conducted approximately at a temperature under 250° C. so that the brazing or connecting can be performed at a temperature where the strength of the material is not lowered, thereby being capable of thinning the thickness of a member, such as a plate.

As a plate material, the aluminum alloy defined in "JIS H 0001" is superior to strength, and therefore, the thickness of the components such as the heat-exchanging plate 12*a*, 12*b* or the like may be significantly reduced, which is used in a laminated component such as the core.

Instead of the above-described brazing process using the cladding material having the melting point lower than 250° C., an attaching process can be performed in which the assembled components including plural heat-exchanging plate members are laminated and fixed with each other with an attaching material interposed therebetween by a jig to support the assembly, and then, the assembly is transferred into a heating chamber and the attaching process is performed at a temperature in a range around 200° C. and 250° C.

(Second Embodiment)

Figure 7:
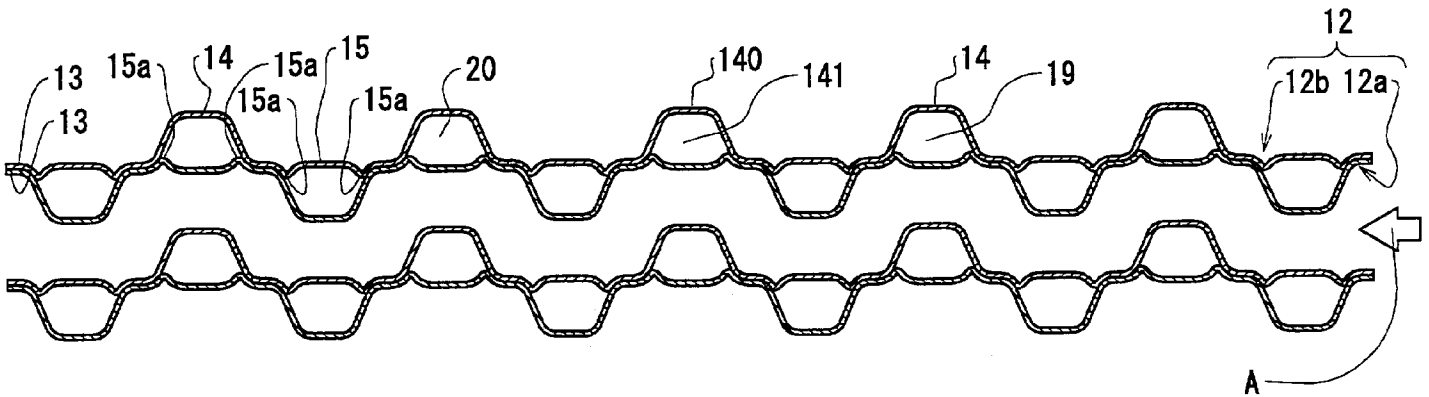
FIG. 7 is a cross-sectional view showing a heat-exchanging plate according to a second embodiment of the present invention.

In the first embodiment described above, the projection rib 14 has a semicircular, elliptic-like section, and the fluid passage forming portion 15 has two contact portions 15*a* each of which has a pointed, pin-like, mountain-like section protruding along the inner surface of the projection rib 14 to contact it. However, it is not limited to use these shapes of member plates. For example, as shown in FIG. 7, a projection rib 14 may have a trapezium-like section, and fluid passage forming portion 15 may have two contact portions 15*a* similar to those in the first embodiment.

In this embodiment, the connecting strength between the projection ribs 14 and the end plates 22 can be improved since the projection ribs 14 can have a flat portion, respectively, so as to increase the area contacting the end plates 22. Moreover, it is easier to form the projection rib 14 having the flat portion in the press process than to form the projection rib 14 in the first embodiment. Namely, the manufacturing cost may be reduced to form the projection ribs 14 in the second embodiment.

(Third Embodiment)

Figure 8:
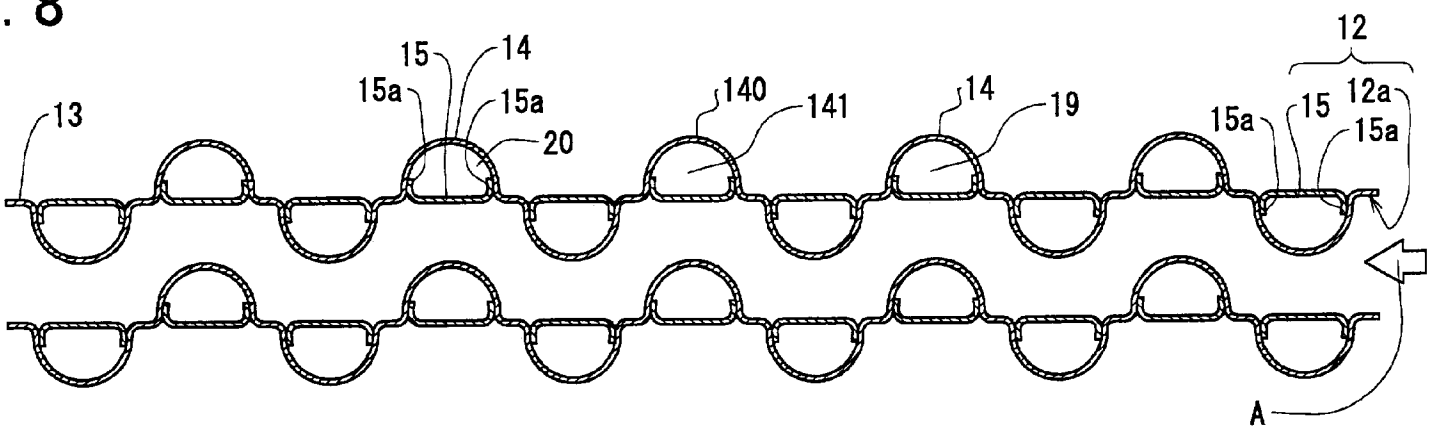
FIG. 8 is a cross-sectional view showing a heat-exchanging plate according to a third embodiment of the present invention.

In the first, and second embodiments, each of the first and second heat-exchanging plates 12*a* and 12*b* is provided with the projection ribs 14 and the fluid passage forming portions 15, and the first heat-exchanging plate 12*a* is attached to the second heat-exchanging plate 12*b* to form the refrigerant passages 19 and 20. To the contrary, in this embodiment, as shown in FIG. 8, the first heat-exchanging plate 12*a* has the semicircular, elliptic-like section, which is sealed with a fluid passage forming member 15' having contact portions 15*a*. In this embodiment, unlike the first or second embodiment, the heat-exchanging plate member 12' does not have an area where the second heat-exchanging plate 12*b* overlaps on the first heat-exchanging plate 12*a* since the second heat-exchanging plate 12*b* is not required. Therefore, the heat-exchanging member 12 can be lightened.

(Fourth Embodiment)

Figure 9:
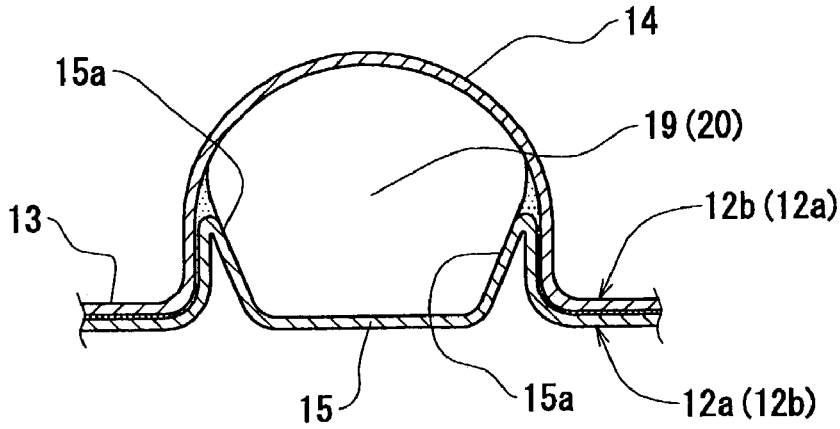
FIG. 9 is a cross-sectional view showing a coolant passage according to a fourth embodiment of the present invention.

As shown in FIG. 9, contact portions 15*a* may be formed to have a mountain-like section which has a wide space at its bottom as compared to the contact portions 15*a* shown in FIG. 3B. This shape also allows ease when forming the portion by a press process. Therefore, the manufacturing cost can be reduced.

Figure 10:
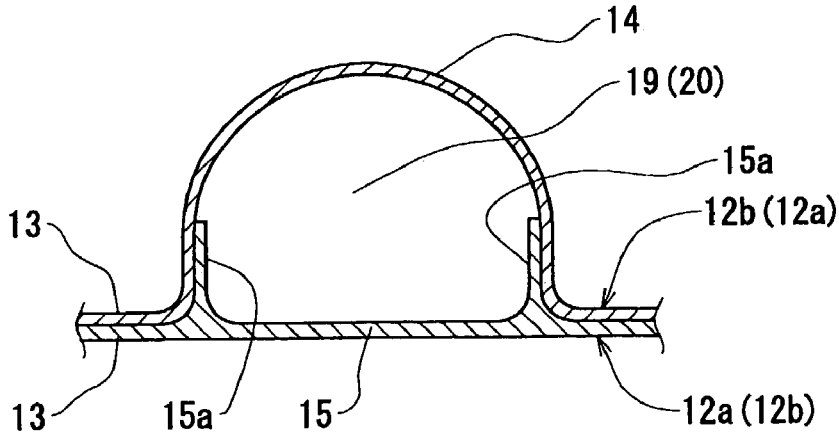
FIG. 10 is a cross-sectional view showing the coolant passage according to the fourth embodiment of the present invention.

Alternatively, as shown in FIG. 10, contact portions 15*a* can be formed by an extruding process. The number of steps is smaller in a press process than in an extruding process.

(Fifth Embodiment)

In the above-mentioned embodiments, the contact portions 15*a* are employed in the fluid passage forming portion 15 to form the refrigerant passage 19, 20. To the contrary, in this embodiment, a fluid passage forming portion 15 does not have contact portions 15*a* unlike the fluid passage forming portion 15 described in the other embodiments.

Figure 11:
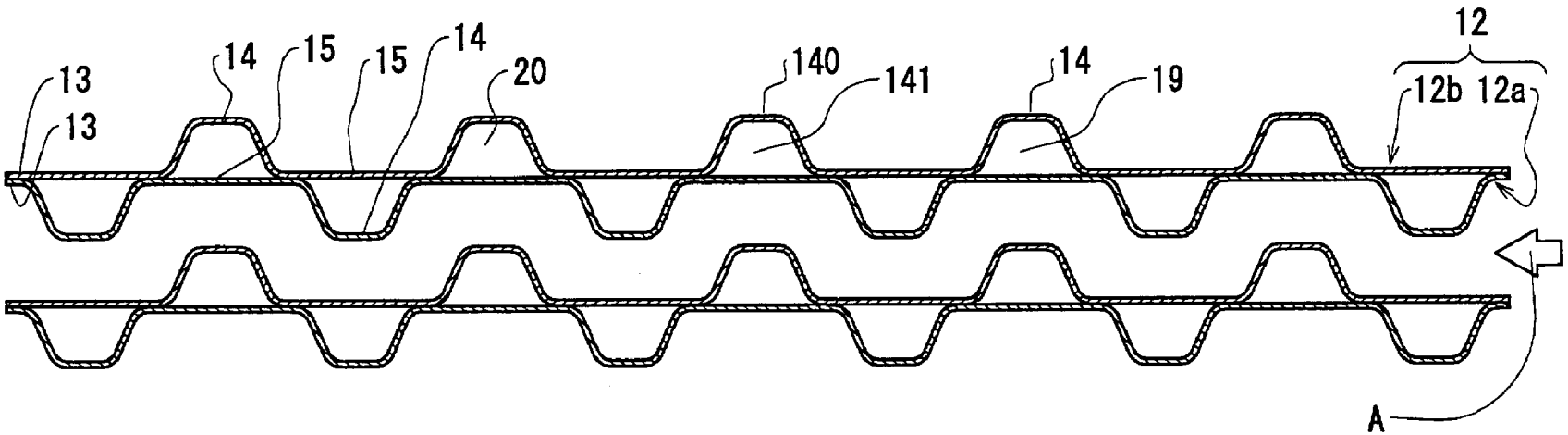
FIG. 11 is a cross-sectional view showing a heat-exchanging plate according to a fifth embodiment of the present invention.

As shown in FIG. 11, each plate 12*a*, 12*b* has projection ribs 14 (140) and fluid passage forming portions 15. The plate 12*a* is attached to the plate 12*b* so as to contact and connect the fluid passage forming portions 15, formed in the respective plates, to each other so that the projection ribs 14 (140), formed in the respective plates, face outward with each other to form refrigerant passages 19 and 20 inside the projection ribs 14 (140) as shown in FIG. 11.

This feature is shown in FIG. 6, as the basic form, and can be lowered in the strength at the connecting portion in relation to the magnitude of the principal stress at the bonding surface and the connecting member. However, as described in the first embodiment, when the component is connected with the other components in the assembly by using the cladding material having the low melting point as compared to the conventional one in the low-temperature integral brazing at the temperature around 250° C., the strength of the material is not lowered.

Namely, even if the strength at the connecting portion is lowered in this embodiment, the thickness of the member can be thinned when the structure in this embodiment is employed in a heat exchanger such as a heater core in a vehicle air conditioner, which circulates hot water and has a withstanding strength lower than that of a heat exchanger which circulates refrigerant.

Although the present invention is applied to the evaporator 10 in the above-described embodiment in which the low-pressure refrigerant for the refrigerant cycle flows in the refrigerant passages 19 and 20 in the heat-exchanging member 12, and the air flows outside of the heat-exchanging member 12, the present invention is not limited to the above-described embodiments. The present invention will be utilized in, for example, a general heat exchanger in which heat-exchanging is conducted between inside fluid and outside fluid in several usages.

While the present invention has been shown and described with reference to the foregoing preferred embodiment, it will be apparent to those skilled in the art that changes in form and detail may be therein without departing from the scope of the invention as defined in the appended claims.

What is claimed is:

1. A heat exchanger comprising:

a plurality of heat-exchanging plate members, each of which has a plurality of projection ribs to form inside fluid passages through which inside fluid flows; and a heat-exchanging core portion containing the plurality of heat-exchanging plate members, wherein each of the plurality of heat-exchanging plate members is disposed adjacent another of the plurality of heat-exchanging plate members, said heat-exchanging core portion having a space between adjacent disposed heat-exchanging plate members to which said plurality of projection ribs are exposed to disturb a flow of outside fluid in said space, wherein:

each of said plurality of heat-exchanging plate members has fluid passage forming portions;

each of the projection ribs has an elongated opening in a longitudinal direction thereof;

the fluid passage forming portions are positioned in such a manner as to confront inner surfaces of the projection ribs which define the elongated openings;

each of the fluid passage forming portions has a substantially flat wall which cooperates with a respective projection rib to define the inside fluid passage;

each of the fluid passage forming portions has contact portions which are positioned at both sides of the flat wall and are connected to the inner surface of the respective projection rib;

the contact portions protrude inside of the respective projection rib so as to be connected to the inner surface of the respective projection rib in such a manner that a stress is applied to the connection between the contact portions and the inner surface of the projection rib is a shearing stress; and said contact portion in each fluid passage forming portion has a convex shape protruding along said inner surface of the respective projection ribs.

2. A heat exchanger according to claim 1, wherein each heat-exchanging plate member has two plates each of which has said fluid passage for portions and said plurality of projection ribs arranged alternately, wherein when the two plates are connected to each other in a manner that said plurality of projection ribs formed in said two plates, respectively, face outwardly with each other, the respective fluid passage forming potions in one of said two plates are connected to the respective projection ribs formed in the other of said two plates to define said inside fluid passages.

3. A heat exchanger according to claim 1, wherein each heat-exchanging plate member has one plate which defines projection ribs, said fluid passage forming portions being connected to respective projection ribs to define the inside fluid passages.

4. A heat exchanger according to claim 1, wherein said contact portion in each fluid passage forming portion is connected to said inner surface of the respective projection rib by an attaching process at less than a predetermined temperature.

5. A heat exchanger according to claim 4, wherein said predetermined temperature is approximately 250° C.

6. A heat exchanger according to claim 4, wherein said plurality of heat-exchanging plate members are made of aluminum alloy having H-material grade.

7. A heat exchanger according to claim 4, wherein said plurality of heat-exchanging plate members are made of aluminum alloy subjected to heat treatment.

8. A heat exchanger according to claim 1, wherein the fluid passage forming portions are separate from the plurality of projection ribs.

9. A heat exchanger comprising:

a core portion having a plurality of plate members which define a plurality of passages for channeling a first medium pressurized higher than that of a second medium flowing outside the passages, wherein each of the passages comprises:

a first plate member providing a projection rib which is formed in a projection shape in a cross section perpendicular to the passage and extending in a longitudinal direction of the passage, the projection rib being terminated by end openings at both longitudinal ends of the passage and being terminated by bent ridges provided by bending the first plate member at both sides to define a longitudinal opening formed in a slot shape extending in the longitudinal direction of the passage;

a second plate member providing a passage forming portion placed on the longitudinal opening of the projection rib to close the longitudinal opening and a pair of contact portions extending from both sides of the passage forming portion to inside the projection rib along an inner surface of the projection rib to define narrow gaps between the contact portions and the projection rib; and connecting members made of connecting material for connecting the contact portions and the projection rib, the connecting members being provided in the narrow gap between the contact portions and the projection rib, the connecting members being formed in a thin sheet shape spreading along the inner surface of the projection rib: wherein the contact portions are provided by bending the plate members so that portions of the plate member as the contact portions extend alone the inner surface of the projection rib from the bent edges of the projection rib; and the contact portions are provided by folding portions of the plate members in parallel to form a narrow gap between folded portions and by filling the gap with connecting material.

10. The heat exchanger according to claim 9, wherein:

the projection rib on the first plate member is provided as a first projection rib which protrudes perpendicular to a flow direction of the second medium, the passage forming portion and the pair of the contact portions on the second plate member are provided as a first passage forming portion and a first contact portions, the connecting members are provided as first connecting members, the second plate member further provides a second projection rib being located next to the first passage forming portion and the first contact portions, the second projection rib being formed in a projection shape protruding in an opposite direction to the first projection rib in a cross section perpendicular to the passage and extending in a longitudinal direction of the passage, the second projection rib being terminated by end openings at both longitudinal ends of the passage and being terminated by bent ridges provided by bending the first plate member at both sides to define a longitudinal opening formed in a slot shape extending in the longitudinal direction of the passage, and the first plate member further provides a second passage forming portion placed on the longitudinal opening of the second projection rib to close the longitudinal opening and a pair of second contact portions extending from both sides of the second passage forming portion to inside the second projection rib along an inner surface of the second projection rib to define narrow gaps between the second contact portions and the second projection rib, and wherein the heat exchanger further comprises, second connecting members made of connecting material for connecting the second contact portions and the second projection rib, the second connecting members being provided in the narrow gaps between the second contact portions and the second projection rib, the second connecting members being formed in a thin sheet shape spreading along the inner surface of the second projection rib.

11. The heat exchanger according to claim 10, wherein the heat exchanger comprises a plurality of plate sets disposed in parallel to each other, each of the plate sets being made of the first plate member and the second plate member, and the plate sets defining a wave shape channel therebetween in which the second medium flows.

12. The heat exchanger according to claim 9, wherein the connecting members receive shearing stress when the first and second plate members receive pressure from the first medium.

13. A heat exchanger comprising:

a core portion having a plurality of plate sets disposed in parallel to each other to define a plurality of channels therebetween, each of the plate sets defines a plurality of passages for channeling a first medium pressurized higher than that of a second medium flowing in the channels between the plate sets, wherein each of the plate sets comprises:

a first plate member providing a plurality of projection ribs which are formed in a projection shape in a cross section perpendicular to the passage and extending in a longitudinal direction of the passage, each of the projection ribs being terminated by end openings at both longitudinal ends of the passage and being terminated by bent ridges provided by bending the first plate member at both sides of the projection rib to define a longitudinal opening formed in a slot shape extending in the longitudinal direction of the passage;

a second plate member providing a plurality of passage forming portions corresponding to the longitudinal openings of the projection ribs to close the longitudinal openings and a plurality of pairs of contact portions extending from both sides of the passage forming portions to inside the projection ribs along an inner surface of the projection ribs to define narrow gaps between the contact portions and the projection ribs; and connecting members made of connecting material for connecting the contact portions and the projection ribs, the connecting members being provided in the narrow gaps between the contact portions and the projection ribs, the connecting members being formed in thin sheet shapes spreading long the inner surfaces of the projection ribs; wherein the second plate member further provides a plurality of projection ribs which are formed in a projection shape in a cross section perpendicular to the passage and extending in a longitudinal direction of the passage, each of the projection ribs being terminated by end openings at both longitudinal ends of the passage and being terminated by bent ridges provided by bending the first plate member at both sides of the projection rib to define a longitudinal opening formed in a slot shape extending in the longitudinal direction of the passage, each of the projection ribs being provided between the passage forming portions, and the first plate member further provides a plurality of passage forming portions corresponding to the longitudinal openings of the projection ribs formed on the second plate member to close the longitudinal openings and a plurality of pairs of contact portions extending from both sides of the passage forming portions to inside the projection ribs along an inner surface of the projection ribs to define narrow gaps between the contact portions and the projection ribs providing a plurality of projection ribs which are formed in a projection shape in a cross section perpendicular to the passage and extending in a longitudinal direction of the passage, each of the projection ribs being terminated by end openings at both longitudinal ends of the passage and being terminated by bent ridges provided by bending the first plate member at both sides of the projection rib to define a longitudinal opening formed in a slot shape extending in the longitudinal direction of the passage, and wherein the heat exchanger further comprises:

connecting members made of connecting material for connecting the contact portions formed on the first plate member and the projection ribs formed on the second plate member, the connecting member being provided in the narrow gaps between the contact portions and the projection ribs, the connecting member being formed in thin sheet shapes spreading along the inner surfaces of the projection ribs; wherein the connecting members receive shearing stress when the first and second plate members receive pressure from the first medium; and the contact portions are provided by bending the first and second plate members so that portions of the first and second plate members as the contact portions extend along the inner surface of the projection ribs from the bent edges of the projection ribs.

14. The heat exchanger according to claim 13, wherein each of the projection ribs is formed with an arc shaped portion and straight portions extending from respective sides of the arc shaped portion to the bent ridges, and the contact portions are formed in parallel with the straight portions to define the gaps therebetween.

15. The heat exchanger according to claim 14, wherein the contact portions are provided by folding the first and second plate members in parallel so as to define narrow gaps between folded portions and by filling the gaps with connecting material.

16. The heat exchanger according to claim 15, wherein the folded portions provides a distal end sharply folded and placed on the inner surface of the projection rib, an outer round corner formed in a round shape along the bent ridge on the projection rib, and an inner round corner bent in a round shape, wherein the connecting material filled in the gap between the folded portions further fills a V shaped groove defined between the round corner.

* * * * *